US008448879B2

(12) United States Patent
Krug et al.

(10) Patent No.: US 8,448,879 B2
(45) Date of Patent: May 28, 2013

(54) APPARATUS FOR DISCHARGING SPRAYS OR MISTS, COMPRISING AN OSCILLATING FIRE BURNER, AND MIST PIPE FOR SUCH AN APPARATUS

(75) Inventors: Nikolaus Krug, Leutkirch (DE); Martin Eisleb, Isny (DE)

(73) Assignee: Swingtec GmbH, Isny (DE)

( * ) Notice: Subject to any disclaimer, the term of this patent is extended or adjusted under 35 U.S.C. 154(b) by 412 days.

(21) Appl. No.: 12/738,431

(22) PCT Filed: Sep. 23, 2008

(86) PCT No.: PCT/EP2008/008018

§ 371 (c)(1),
(2), (4) Date: Jul. 1, 2010

(87) PCT Pub. No.: WO2009/049748

PCT Pub. Date: Apr. 23, 2009

(65) Prior Publication Data

US 2010/0282863 A1 Nov. 11, 2010

(30) Foreign Application Priority Data

Oct. 17, 2007 (DE) ..... 10 2007 051 063

(51) Int. Cl.

| | |
|---|---|
| ***B05B 7/00*** | (2006.01) |
| ***B05B 15/00*** | (2006.01) |
| ***B05B 7/08*** | (2006.01) |
| ***B05B 7/04*** | (2006.01) |

(52) U.S. Cl.

USPC ..... 239/427; 239/132.3; 239/434; 43/900; 60/247

(58) Field of Classification Search

USPC ..... 239/77, 78, 125, 128, 129, 418, 419, 239/419.3, 422, 434.5, 132, 132.1, 132.3, 239/132.5, 398, 423, 424, 426, 427, 428, 239/433, 434; 43/129, 132.1, 900; 123/3; 60/247; 261/35, 37, DIG. 8

See application file for complete search history.

(56) References Cited

U.S. PATENT DOCUMENTS

| | | | | |
|---|---|---|---|---|
| 2,655,406 | A * | 10/1953 | Loy et al. | 123/3 |
| 2,857,332 | A * | 10/1958 | Tenney et al. | 139/136 |
| 2,858,162 | A * | 10/1958 | Frank | 239/129 |
| 2,959,214 | A * | 11/1960 | Durr et al. | 431/1 |
| 3,575,349 | A * | 4/1971 | Stahl et al. | 239/135 |
| 3,855,148 | A * | 12/1974 | Locher et al. | 239/77 |

(Continued)

FOREIGN PATENT DOCUMENTS

| | | | |
|---|---|---|---|
| DE | 3225933 | A1 | 1/1984 |
| DE | 19856169 | A1 | 6/2000 |
| GB | 2090335 | A | 7/1982 |

*Primary Examiner* — Darren W Gorman
(74) *Attorney, Agent, or Firm* — Gudrun E. Huckett

(57) ABSTRACT

Such apparatuses are used for discharging active substances along with various carrier media, water often being used as a carrier medium. In order to ensure that the water perfectly nebulizes together with the active substance, the mist pipe (10) comprises at least three additional pipes (3 to 6) which partly surround each other to form annular chambers (31 to 33). Such a mist pipe (10) allows the size distribution of the drops to be kept within narrow limits even when water is used as a carrier medium. The nebulizer and the mist pipe (10) are mainly used in the health sector, in agriculture, plantations and greenhouses, for protecting supplies and for disinfection purposes on humans, in animal husbandry, and in food production.

20 Claims, 3 Drawing Sheets

U.S. PATENT DOCUMENTS 4,343,719 A 8/1982 Stevens et al.
4,811,901 A * 3/1989 Stevens et al. ..... 239/138
4,934,601 A * 6/1990 Stevens et al. ..... 239/138
5,287,696 A * 2/1994 Shigemi ..... 60/786

* cited by examiner

APPARATUS FOR DISCHARGING SPRAYS OR MISTS, COMPRISING AN OSCILLATING FIRE BURNER, AND MIST PIPE FOR SUCH AN APPARATUS

BACKGROUND OF THE INVENTION

The invention concerns an apparatus for discharging sprays or mists, comprising an oscillating fire burner to which is connected a resonator, into which a supply line for the mist material opens and which projects into a first pipe of a mist pipe, as well as a mist pipe for such an apparatus.

Such apparatus are utilized for discharging active ingredients (preparations) with different carrier materials. The carrier material serves to discharge the entrained active ingredient, for example, insecticides, fungicides, pesticides, disinfecting agents, in mist form (aerosols). As a carrier material water is frequently used. The use of aqueous active ingredient mixtures (preparation mixtures), in the following referred to as mist material, with water as a carrier material is critical when a conventional mist pipe is used. When misting with such a mist pipe, a very broad droplet spectrum is generated with a high proportion of large droplets that are not able to float.

The invention has the object to design the apparatus of the aforementioned kind and the mist pipe of the aforementioned kind in such a way that a proper misting action of the water with the active ingredient is ensured.

SUMMARY OF THE INVENTION

This object is solved in connection with the apparatus of the aforementioned kind for discharging sprays and mists in accordance with the present invention in that the mist pipe comprises at least three further pipes that, with formation of annular chambers, overlap one another at least partially, and in connection the mist pipe of the aforementioned kind in accordance with the present invention in that mist pipe has at least four pipes that have in the direction of the free end increasingly greater radius and each project axially past the inner pipe, respectively.

The apparatus according to the invention has a mist pipe suitable for discharging aqueous mists comprising at least four pipes that are partially inserted into one another with formation of annular passages with the purpose of generating only floating droplets (aerosols) and to exclude large non-floating droplets. Should upon misting at the end of the third pipe larger droplets be formed, they fall onto the projecting parts of the fourth pipe and are caught in this way. In this way, the size distribution of the droplets can be kept within narrow limits. Therefore, the throughput (liter per hour) of the water-based mist material can be significantly increased and still an optimal misting with a good aerosol droplet spectrum can be achieved. Of course, as needed, further pipes can be provided.

Advantageously, the third pipe is provided with at least one suction opening for larger mist droplets contained within the annular passage. The exhaust gas/cooling air stream flowing through the mist pipe at high speed generates via the suction opening of the third pipe a vacuum in the annular passage. The larger droplets that have been caught by the fourth pipe are thereby sucked into the annular passage and pass through the suction opening into the third pipe. Here they are entrained by the exhaust gas/cooling air stream and broken apart.

In case of further pipes it is advantageous that each further pipe is provided with at least one suction opening for the droplets exiting from the preceding pipe.

Further features of the invention result from the additional claims, the description, and the drawings.

BRIEF DESCRIPTION OF THE DRAWINGS

The invention will be explained in the following in more detail with the aid of an embodiment illustrated in the drawings. It is shown in.

DESCRIPTION OF PREFERRED EMBODIMENTS

Figure 1:
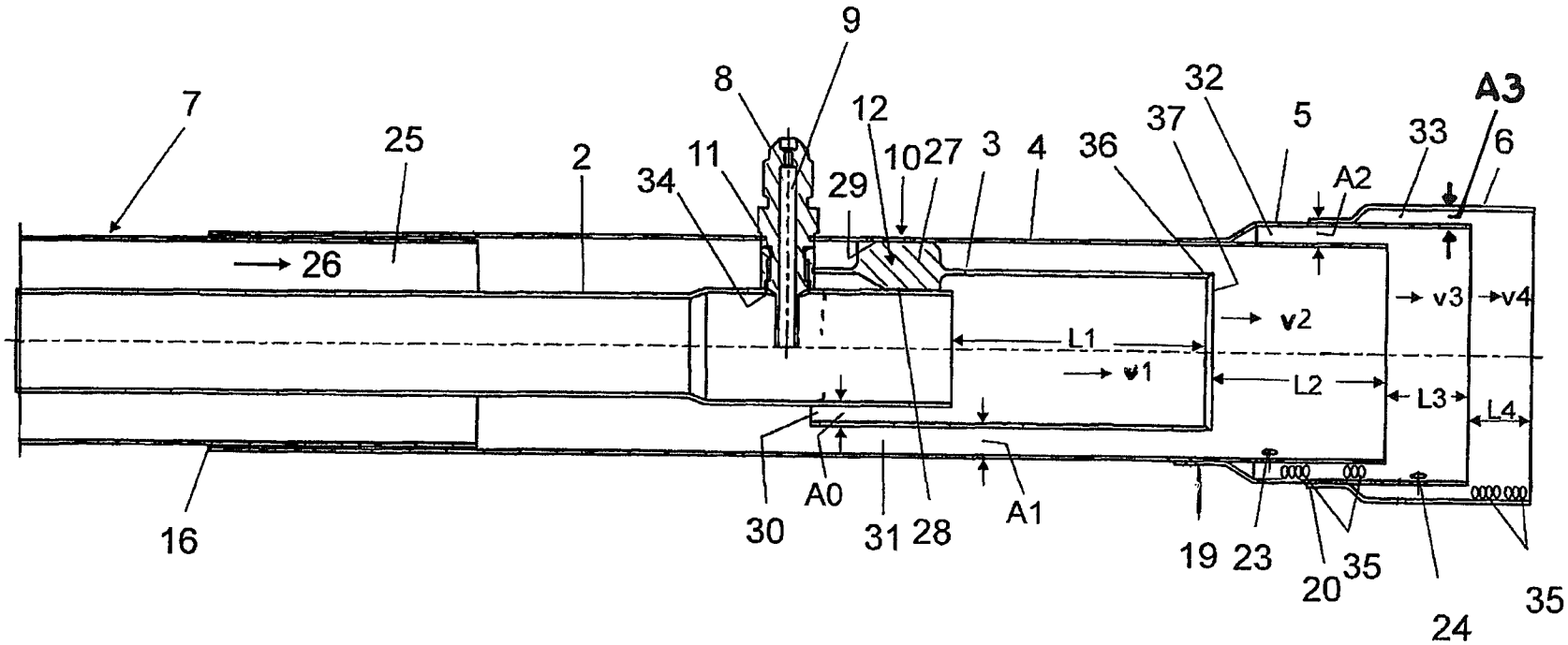
FIG. 1 in axial section a mist pipe according to the invention that is placed onto a resonator and a cooling pipe of a misting apparatus.
Figure 2:
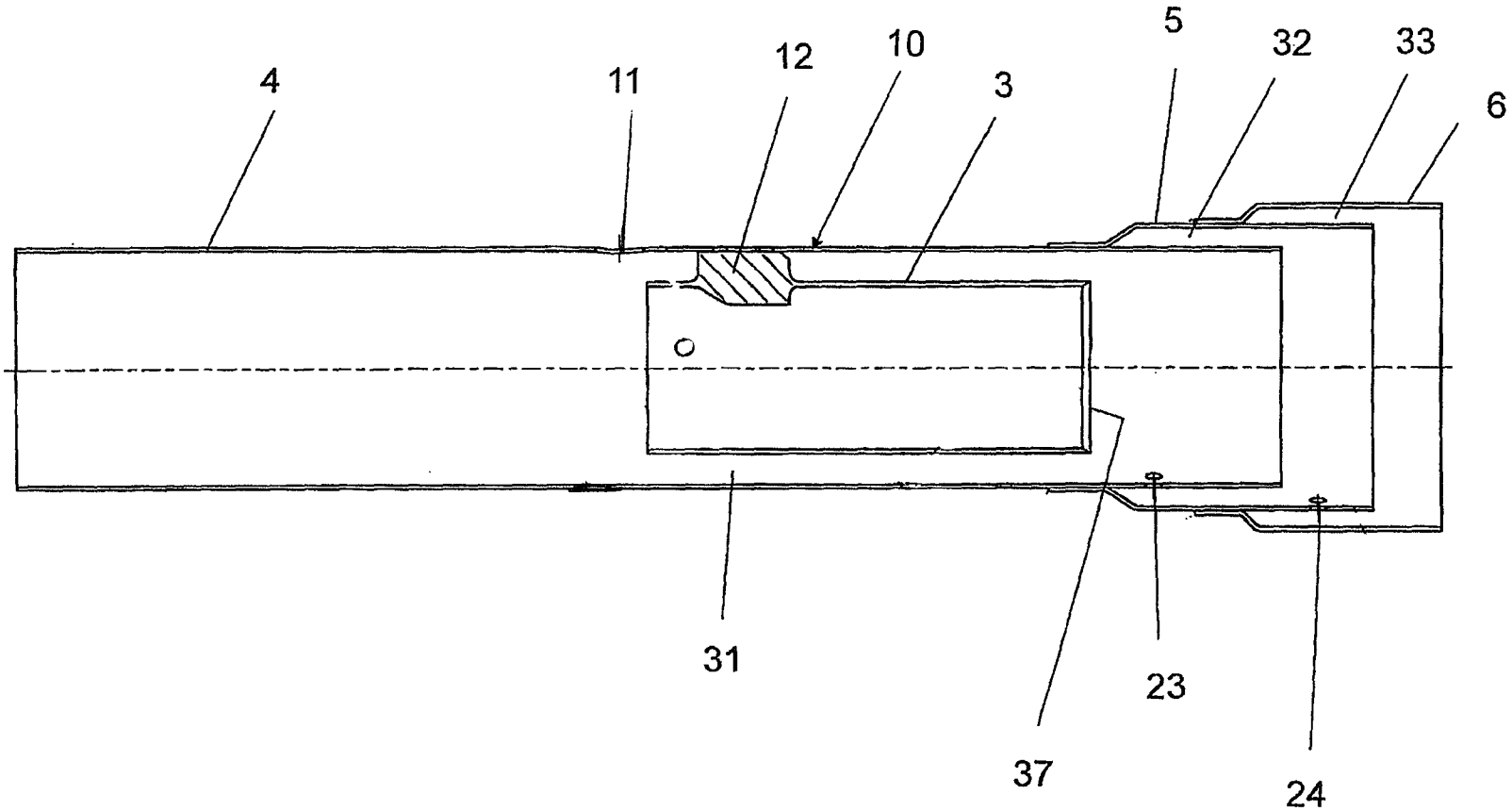
FIG. 2 the mist pipe according to FIG. 1 without the resonator in an illustration in accordance with FIG. 1.

The mist pipe 10 illustrated in FIGS. 1 and 2 is a high-performance mist pipe that is placed onto a resonator 2 and a cooling pipe 7. The resonator 2 is a cylindrical pipe that forms the extension of an oscillating fire burner. Near its end facing away from the resonator 2 a supply line opens into the oscillating fire burner by means of which fuel, preferably gasoline, from a tank that is part of the misting apparatus is supplied. In the oscillating fire burner the gasoline is combusted wherein the combustion of the gasoline generates regular explosions that in the resonator or oscillation pipe 2 cause the gas column to oscillate. Into this oscillating gas stream near the forward end of the resonator pipe 2 the mist material is supplied by a supply line 9 and is broken apart into smallest particles. The supply line 9 is provided in a connecting member 8 that projects through an opening 11 in the pipe 4 and extends to the resonator 2. It is provided with an opening 34 through which the supply line 9 projects into the resonator 2 preferably to about half the cross-sectional height. The pipe 3 rests with one end against the connecting member 8.

The mist material is comprised of a mixture of an active ingredient, generally an active ingredient formulation, for example, an insecticide, a pesticide, a fungicide, or a disinfecting agent, with a carrier material that in the present example is preferably water. The mist material is contained in an active ingredient tank (not illustrated) from which it is conveyed in a known manner. From the mist pipe 10 that is configured of the oscillating fire burner, the resonator 2 and the cooling pipe 7, the mist material then will exit, prepared as a floating aerosol mist.

The cooling pipe 7 surrounds the oscillating fire burner and the resonator 2 at a spacing and extends coaxially to them. By means of at least one opening at the end of the cooling pipe 7 facing away from the resonator 2 during use of the misting apparatus primary cooling air is sucked in. It is sucked in by the exhaust gas that exits at high speed from the resonator 2 as a result of the vacuum created thereby. This primary cooling air flows then in the annular space 25 between the oscillating fire burner and the resonator 2 in the direction of arrow 26 in FIG. 1. Through this cooling air flow the wall of the resonator 2 and of the resonator combustion chamber is cooled. The primary cooling air mixes with the exhaust gas/mist material mixture at the exit end of the resonator 2. By this mixing action the temperature of the mist material/exhaust gas/air mixture is reduced.

The misting apparatus is mainly used in the health-care field for fighting malaria, dengue fever and other diseases that are transmitted by mosquitoes and for fighting flying and crawling insects etc.; in agriculture, it is used for plant protection measures, in plantations, and greenhouses as well as in storage protection for pest control in warehouses and silos and for inhibiting potato germination. Further fields of use are disinfection measures on humans, in animal husbandry, and food production.

The resonator 2 projects axially past the cooling pipe 7. The mist pipe 10 has a first pipe 3 that is surrounded by a second pipe 4 of the mist pipe 10 at a spacing. The second pipe 4 projects past the first pipe 3 at both ends. With one projecting end 16 the second pipe 4 is pushed onto the cooling pipe 7.

The inner first pipe 3 is secured by a spacer 12 within the second pipe 4. The spacer 12 is advantageously star-shaped and has, for example, three arms 27 distributed about the circumference that each have at the radial inner and outer sides 28, 29 contact surfaces with which the arms 27 rests against the resonator 2 or against the inner side of the second pipe 4. In this way, the pipe 3 is aligned properly relative to the resonator 2 and the pipe 4. The pipes 2 to 4 are positioned coaxially to one another. Between the resonator 2 and the pipe 3 an annular passage 30 and between the two pipes 3 and 4 an annular passage 31 is formed.

A pipe 5 is attached on the pipe 4. It is significantly shorter than the pipe 4 and is seated with an end section 19 having a reduced diameter on the pipe 4. So that between the end section 19 and the pipe 4 in the area of the misting apparatus no air is sucked in, the end section 19 rests tightly against the exterior side of pipe 4. This can be achieved by a seal-tight weld in a simple way in order to prevent that in operation of the mist apparatus air can be sucked in between the end section 19 and the pipe 4. The pipe 5 surrounds the pipe 4 at a spacing so that between the two pipes 4, 5 an annular space 32 is formed. The pipe 5 projects axially past the pipe 4. The annular space 32 tapers across a small axial length at the transition to the annular end section 19. A pipe 6 is seated with an end section 29 having a reduced diameter on the pipe 5 and projects axially past the pipe 5. The end section 20 is seated on the pipe 5, preferably by means of a weld, so that in use of the misting apparatus no air can be sucked in between the end section 20 and the pipe 5. Between the two pipes 5, 6 an annular passage 33 is formed which tapers at the transition to the annular end section 20 across a small axial length.

The mist pipe 10 in the described embodiment is comprised of four stages wherein the four stages are formed by the coaxially positioned pipes 3 to 6. Depending on the use of the misting apparatus the mist pipe 10 may have additional stages that are also each formed by pipes that are embodied and attached in accordance with the pipes 5, 6. The stages 3 to 6 are matched relative to one another such that an optimal discharge of the mist material is achieved. Since the inner cross-section increases from the resonator 2 toward the pipe 6, the flow velocity v1 to v4 of the exhaust gas/mist material/cooling air mixture decreases accordingly. The mixture has at the exit from the resonator 2 the highest and at the exit of the pipe 6 the lowest flow velocity.

This stepping of the flow velocities v1 to v4 is matched to the length of the projecting parts of the pipes 3 to 6 and/or to the exit surface area of the annular passages 30 to 33 and/or the volume of the pipes 3 to 6. Also, the cross-sectional surface areas and the volumes of the pipes 3 to 6 are matched relative to one another in order to achieve a large discharge quantity of the mist material with lowest possible undesirable formation of large non-floating droplets.

Figure 3:
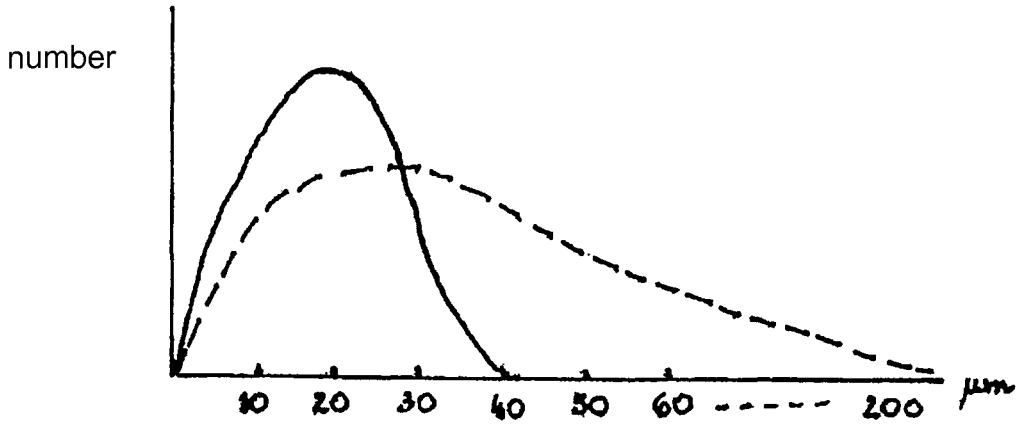
FIG. 3 in schematic illustration the droplet distribution upon misting with the apparatus according to the invention.

FIG. 3 shows approximately the droplet distribution in the discharged mist. With the dash-dotted line the droplets spectrum of conventional misting apparatus or mist pipes is illustrated. It is characterized in that very different droplets sizes occur in a broad droplet spectrum which is apparent by the flat curve. In particular, a high proportion of very large droplets occurs that will deposit in immediate vicinity of the apparatus; this decreases and impairs the efficiency of an application significantly. Fewer droplets and thus less active ingredient will reach the application target.

Entirely different conditions exist when using the described mist pipe 10. As indicated by the solid line, the greatest portion of the droplets has a diameter in the range between approximately 10 m approximately 30 m. The proportion of larger droplets is minimal. This optimal droplet distribution is achieved with water as carrier material. This droplet spectrum is only minimally wider than the droplet spectrum that occurs upon discharge of mist material in which oils are used as a carrier material and which are operated with conventional mist pipes.

As a result of the described configuration of the mist pipe 10, the throughput of the exhaust gas/mist material/cooling air mixture with water as carrier material can be significantly increased while providing an optimal droplet spectrum.

The numerical values described in the following are to be understood as an example and do not limit the invention to these values.

The projecting length of the pipes 3 to 6 past the inner pipe, respectively, is referenced in FIGS. 1 at L1 to L4. The pipe 3 projects by the length L1 past the resonator pipe 2. Correspondingly, the pipe 4 projects with length L2 past the pipe 3 and the pipe 5 with length L3 past the pipe 4. In this connection, the following applies:

L1>L2>L3>L4

The ratio L1:L2 is in a range between approximately 1:0.6 to approximately 1:0.7. The length ratio L2:L3 is between approximately 1:0.4 and approximately 1:0.5, while the length ratio L3:L4 is between approximately 1:0.7 and approximately 1:0.8.

In one embodiment, the lengths are as follows:

L1=63 mm

L2=42 mm

L3=20 mm

L4=15 mm

The cross-sectional surface areas of the annular passages 30 to 33 are identified in FIG. 1 with A0 to A3. The annular passage 30 has the smallest cross-sectional surface area A0 while the neighboring annular passage 31 has the largest cross-sectional surface area A1. In this way, the primary cooling air that flows in direction 26 in the annular space 25 has in the annular passage 30 a higher flow velocity than in the annular passage 31. The exhaust gas/mist material mixture exiting at high speed from the resonator 2 is mixed with the cooling air that flows also at high speed through the annular passage 30.

The annular passage 32 has the cross-sectional surface area A2 that is smaller than the cross-sectional surface area A1 of the annular passage 31 but greater than the cross-sectional surface area A3 of the annular passage 33. The annular passages 32, 33 have the task to catch larger droplets that have formed in the pipes 4 and 5 and to return them to the exhaust gas/mist material/cooling air mixture flowing through the mist pipe 10. For this purpose, the pipes 4 and 5 each are provided with at least one opening 23, 24 that opens into the annular passage 32, 33, respectively.

In use of the misting apparatus it cannot be prevented that at the exit end of the pipes 4, 5 larger droplets 35 are formed that are no longer entrained by the exhaust gas/mist material/cooling air mixture. These droplets 35 drop onto the next pipe. respectively. By means of the mixture that is flowing at high speed through the pipes 4, 5 via the openings 23, 24 in the annular passages 32, 33 a vacuum is created. By means of it the droplets 35 are sucked into the annular passage 32, 33, respectively, and are returned through the openings 23, 24 into the exhaust gas/mist material/cooling air stream. The droplets 35 are entrained by it and broken apart.

The vacuum action in the annular passages 32, 33 is so high that the pipes 5, 6 with their end sections 19, 20 rest seal-tightly against the pipes 4, 5. In this way, no external air will reach the annular passages 32, 33 that would impair the vacuum action.

In the embodiment the cross-sectional surface area

A0 is approximately 20 $mm^2$

A1 is approximately 30 $mm^2$

A2 is approximately 27 $mm^2$

A3 is approximately 22 $mm^2$

The cross-sectional surface areas are matched to one another such that, on the one hand, the exhaust gas/mist material/cooling air mixture exits at high speed from the mist pipe 10 and by doing so, on the other hand, the formation of larger droplets that are non-floating aerosols is limited to a minimum.

The following cross-sectional surface area ratios are optimal:

A0:A1=approximately 1:1.3 up to approximately 1:1.6

A1:A2=approximately 1:0.7 up to approximately 1:0.9

A2:A3=approximately 1:0.7 up to approximately 1:0.8

Since the flow velocity v1 at the exit of the resonator pipe 2 is very high, the projecting length L2 of the pipe 3 can be correspondingly large. Correspondingly, the difference between the volumes of the pipes 3 to 6 can also be correspondingly large.

In the embodiment, the pipes 3 to 6 have the following volumes.

pipe 3 V0=680 $mm^3$ pipe 4 V1=3,000 $mm^3$ pipe 5 V2=1,500 $mm^3$ pipe 6 V3=950 $mm^3$ The volumes refer to the area of the pipes 3 to 6 that project past the respective pipe.

The pipe 4 has the greatest volume V1. Based on this pipe 4 the volumes V2, V3, V4 of the pipes 5, 6 decrease. In connection with the decreasing projecting length L3, L4 and/or the decreasing flow velocity v3, v4, the discharge of the mist material at minimal droplet formation is optimized.

In the embodiment, at the free end of the pipe 3 a slant 36 is provided so that a circumferentially extending annular edge 37 is formed. It is advantageous to provide such slants also on the other pipes 4 to 6. The annular edges form clean break-away edges for optimal droplet preparation.

What is claimed is:

1. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially in a flow direction of the mist material so as to define a first annular passage between the first and second pipes, a second annular passage between the second and third pipes, and a third annular passage between the third and fourth pipes;

wherein the third pipe is provided with at least one suction opening for larger mist material droplets contained within the third annular passage.

2. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially so as to define a first annular passage between the first and second pipes, a second annular passage between the second and third pipes, and a third annular passage between the third and fourth pipes;

wherein the second pipe comprises at least one suction opening for larger mist material droplets contained within the second annular passage.

3. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially so as to define a first annular passage between the first and second pipes, a second annular passage between the second and third pipes, and a third annular passage between the third and fourth pipes;

wherein between the first pipe and the resonator a fourth annular passage is formed that is in flow communication with an annular space through which cooling air flows about the resonator, wherein a width of an annular gap of the fourth annular passage is smaller than a width of an annular gap of the first annular passage.

4. The apparatus according to claim 3, wherein the fourth annular passage has a cross-sectional surface area that is smaller than a cross-sectional surface area of the first annular passage.

5. The apparatus according to claim 3, wherein the second annular passage has a cross-sectional surface area that is greater than a cross-sectional surface area of the fourth annular passage.

6. The apparatus according to claim 3, wherein a cross-sectional surface area of the third annular passage is greater than a cross-sectional surface area of the fourth annular passage.

7. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially so as to define a first annular passage between the first and second pipes, a second annular passage between the second and third pipes, and a third annular passage between the third and fourth pipes, wherein a fourth passage is defined between the resonator and the first pipe;

wherein a first ratio of a cross-sectional surface area was of the fourth passage to a cross-sectional surface area of the first passage is greater than a second ratio of a cross-sectional surface area of the first passage to a cross-sectional surface area of the second passage and the second ratio is greater than a third ratio of a cross-sectional surface was area of the second passage to a cross-sectional surface area of the third passage.

8. The apparatus according to claim 7, wherein the first ratio is between approximately 1:1.3 and approximately 1:1.6.

9. The apparatus according to claim 7, wherein the second ratio is between approximately 1:0.7 and approximately 1:0.9.

10. The apparatus according to claim 7, wherein the third ratio is between approximately 1:0.7 to approximately 1:0.8.

11. The apparatus according to claim 7, wherein a projecting length of the second pipe to the first pipe, of the third pipe to the second pipe and of the fourth pipe to the third pipe, respectively, decreases in a flow direction of the mist material.

12. The apparatus according to claim 11, wherein a projecting length ratio between the first pipe and the second pipe is between approximately 1:0.6 and approximately 1:0.7.

13. The apparatus according to claim 11, wherein a projecting length ratio between the second pipe and the third pipe is between approximately 1:0.4 and approximately 1:0.5.

14. The apparatus according to claim 11, wherein a projecting length ratio between the third pipe and the fourth pipe is between approximately 1:0.7 and approximately 1:0.8.

15. The apparatus according to claim 1, wherein the first pipe has a volume that is defined by an area of the first pipe projecting past the resonator and that is greater than a volume of the second pipe, said volume of the second pipe defined by an area of the second pipe projecting past the first pipe.

16. The apparatus according to claim 1, wherein a volume of the fourth pipe, said volume of the fourth pipe defined by an area of the fourth pipe projecting past the third pipe, is smaller than a volume of the third pipe, said volume of the third pipe defined by an area of the third pipe projecting past the second pipe.

17. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially so as to define a first annular passage between the first and second pipes, a second annular passage between the second and third pipes, and a third annular passage between the third and fourth pipes;

wherein at least the third passage is air-tightly closed off at an end that is positioned opposite to a flow direction of the mist material.

18. An apparatus for discharging a mist material, comprising:

an oscillating fire burner;

a resonator connected to the oscillating fire burner;

a supply line for mist material opening into the resonator;

a mist pipe comprising a first pipe, wherein the resonator extends into the first pipe of the mist pipe;

wherein the mist pipe further comprises a second pipe, a third pipe, and a fourth pipe, wherein the first, second, third and fourth pipes overlap one another at least partially so as to define a first annular passage between the first and second pipes, a second annular passage between the second and third pipes, and a third annular passage between the third and fourth pipes;

wherein the second and third passages are air-tightly closed off at an end thereof that is positioned opposite to a flow direction of the mist material.

19. The apparatus according to claim 1, wherein at least the first pipe has an end facing in the flow direction that is provided at an inner side with a slant for forming an annular edge.

20. A mist pipe comprising a first pipe, a second pipe, a third pipe, and a fourth pipe, wherein the first, second, third and fourth pipes each have in a direction of a free end an increasingly greater radius, respectively, and each project axially past an inwardly positioned one of the pipes, wherein the first, second, third and fourth pipes overlap one another at least partially so as to define a first annular passage between the first and second pipes, a second annular passage between the second and third pipes, and a third annular passage between the third and fourth pipes, wherein the third pipe is provided with at least one suction opening for mist material droplets contained within the third annular passage, wherein the mist pipe is adapted to be disposed on a resonator connected to an oscillating fire burner of an apparatus for discharging mist material.

* * * * *